US006513265B2

(12) United States Patent
Hanks

(10) Patent No.: US 6,513,265 B2
(45) Date of Patent: Feb. 4, 2003

(54) SHOE WITH INFLATABLE TONGUE

(76) Inventor: Robert Hanks, 490 Texas Ave., Bridge City, TX (US) 77611

( * ) Notice: Subject to any disclaimer, the term of this patent is extended or adjusted under 35 U.S.C. 154(b) by 0 days.

(21) Appl. No.: 09/882,687

(22) Filed: Jun. 18, 2001

(65) Prior Publication Data

US 2002/0189135 A1 Dec. 19, 2002

(51) Int. Cl.[7] ..... A43B 23/26; A43B 13/20
(52) U.S. Cl. ..... 36/54; 36/88; 36/29
(58) Field of Search ..... 36/54, 88, 93, 36/29, 3 A, 3 R

(56) References Cited

U.S. PATENT DOCUMENTS 3,372,495 A * 3/1968 Finn ..... 36/117.6
3,664,043 A * 5/1972 Polumbus, Jr. ..... 36/54
4,232,459 A * 11/1980 Vaccari ..... 36/3 R
4,712,316 A * 12/1987 Baggio ..... 36/1
4,730,403 A * 3/1988 Walkhoff ..... 36/117.7
5,113,599 A * 5/1992 Cohen et al. ..... 36/114
5,343,638 A * 9/1994 Legassie et al. ..... 36/28
5,558,395 A * 9/1996 Huang ..... 297/199
5,588,227 A * 12/1996 Goldston et al. ..... 36/29
5,987,779 A * 11/1999 Litchfield et al. ..... 36/29
6,305,102 B1 * 10/2001 Doyle ..... 36/29

* cited by examiner

*Primary Examiner*—M. D. Patterson
(74) *Attorney, Agent, or Firm*—Harrison & Egbert

(57) ABSTRACT

A shoe having a sole, an upper affixed to the sole and extending upwardly therefrom, a tongue fixedly and nonreleasably secured to the upper, an air pump affixed to the toe portion of the upper, a bladder in valved communication with an exhaust of the air pump and affixed to a surface of the tongue, and a deflator affixed to a heel portion of the upper. The deflator is connected in valved relationship to the bladder. A tubing extends along a surface of the upper from the bladder to the deflator. The bladder is inflatable by an action of the air pump. The deflator includes a valve having a pin extending upwardly therefrom and a flexible flap overlying the top of the pin. A downward pressure on the flexible flap will cause air pressure within the bladder to be released.

11 Claims, 4 Drawing Sheets

SHOE WITH INFLATABLE TONGUE

BACKGROUND OF THE INVENTION

1. Field of the Invention

The present invention relates to shoes having inflatable bladders. Additionally, the present invention relates to non-athletic shoes having inflatable bladders positioned within the tongue of the shoe. More particularly, the present invention relates to shoes having an inflation and deflation structure associated with the bladder which allows for the easy placement and removal of the shoe from a human foot.

2. Description of the Related Art

It is known that footwear must provide a stable and comfortable support point for the body while being subject to various types of stress. It is important that the shoe be comfortable and provide adequate support during various foot movements associated with human activity. Articles of footwear typically include an upper and a sole. These articles of footwear are sold in a variety of sizes according to the length and the width of the foot. However, feet of similar length do not necessarily have the same geometry. Therefore, the upper may be adjustable to accommodate various foot contours. Such adjustment may include medial and lateral side portions which, when tensioned, provide support to the foot.

The most common way to adjust the size of a shoe is through lacing. Lacing alone, however, suffers from several disadvantages. For example, when the shoelaces or straps are drawn too tightly, the fastening system can cause pressure on the instep of the foot. Such localized pressure is uncomfortable to the wearer and can make it difficult for the shoe to be worn for prolonged periods of time. Furthermore, while such fastening systems allow the upper of the shoe to be adjustable to accommodate varying foot and ankle configurations, they do not necessarily mold to the contour of the individual feet. Moreover, regardless of how much tension is exerted on the medial and lateral side portions, there still remain areas of the foot which are not supported by the upper, due to the irregular contour of the foot.

Among those persons that are elderly, infirm or overweight, it is often extremely difficult to properly lace shoes. The very action of bending over so as to grasp shoestrings for the purposes of lacing the shoes and tightening the laces can be extremely difficult, if not impossible. Under certain circumstances, back injuries can occur from the action of bending over and applying the pressure necessary to properly lace and tighten the shoestrings. As a result, many of the elderly, infirm or overweight persons will resort to wearing shoes that are easily placed onto the feet and removed from the feet. These shoes are commonly known as loafers or sandals.

Unfortunately, loafers and sandals typically cannot be suitably adjusted so as to fit the contour of the foot in a proper manner. Typically, sandals and loafers will provide inadequate support to the medial and lateral side portions of the foot. As a result, the shoe will tend to flop around on the foot and provide insufficient support for supporting human activity. As a result, a need has developed so as to provide a suitable loafer-type shoe that can be easily placed on the foot or removed from the foot and also adequately supports the medial and lateral side portions of the foot and further to provide proper support to the foot.

In the past, various patents have issued relating to devices having inflatable bladders which serve to more properly secure the shoe to the foot.

U.S. Pat. No. 3,664,043, issued on May 23, 1972 to Polumbus, Jr., describes a footwear accessory which includes an elongated airtight inflatable pad secured in the footwear and a means for injecting compressed air into the pad so that it expands to draw the footwear tightly to the foot. A valve is also provided so as to allow for the release of compressed air from the pad.

U.S. Pat. No. 5,158,767, issued on Oct. 27, 1992 to Cohen et al., describes an athletic shoe provided with an inflatable tongue or bladder for a more secure foot to the user's foot. The bladder is inflated with a pump which has a foam material disposed therein. The bladder is attached to a tongue of an athletic shoe which is initially laced for the purpose of securing the tongue to the upper of the shoe.

U.S. Pat. No. 5,257,470, issued on Nov. 2, 1993 to Auger et al., describes a custom fit bladder system for athletic shoes. This bladder system includes first and second separately pressure adjustable chambers for different foot portions. First and second bladder stems communicate with the first and second chambers, respectively. A tension wire bail secures the stems to a tee manifold between them. A bulb pump held on the shoe includes an articulated connector at one end and a flush mounted inlet valve retained at the other end. A button dial allows the user to select which of the chambers to inflate by pumping the pump and deflate by pushing a deflation valve disposed in the manifold.

U.S. Pat. No. 5,343,638, issued on Sep. 6, 1994 to Legassie et al., teaches an upper for an athletic shoe which substantially takes the form of an inflatable chamber. The upper is formed from first and second laminates which are welded together at various locations to form several fluid impervious chambers. The chambers, which are visible, are inflated with fluid to provide lightweight support and comfort to the foot of the wearer.

U.S. Pat. No. 5,765,298, issued on Jun. 16, 1998 to Potter et al., teaches an athletic shoe with a pressurized ankle collar. This athletic shoe is formed of a sole, an upper attached to the sole and including an ankle portion extending around the medial and lateral malleoli, and an inflatable bladder attached within the ankle portion. The inflatable bladder has a medial section and a lateral section with an inlet mechanism for supply pressurized gas to the interior of the bladder.

U.S. Pat. No. 5,987,779, issued on Nov. 23, 1999 to Litchfield et al., describes an athletic shoe having an inflatable bladder which includes a plurality of chambers with a valve disposed therebetween to selectively inflate the chambers. The inflatable tongue or bladder has a lightweight pump disposed thereon. The inflatable footwear also has an inflation bag under the foot. The inflation bag is formed by two sheets of material that are welded together. A foam layer having apertures is positioned adjacent to the inflation bag.

Unfortunately, in these patents, each of the prior art inflation devices is associated with athletic footwear. One would initially assume that such inflation devices were intended to provide the user with a better fit of an athletic shoe so that athletic performance would improve. As such, the lacing structure of the athletic shoe is provided in combination with the inflation structure. None of these prior art devices is particularly concerned with the ability of the elderly, infirm or overweight to properly secure a shoe to the foot. None of the prior art patents are particularly directed to the use of sandals and/or loafers which can be easily secured to the foot or removed from the foot without the use of one's hands. In each of these cases, the release valve for the air bag must be accessed by human hands so as to release the shoe from the foot. Furthermore, pressure for the inflation of the air bladders within the shoe must be accomplished by the use of human fingers. Since each of these prior art devices are directed toward athletes or to athletic activities, it is assumed that, with each of these prior art devices, there is suitable ability by the user to access the shoe.

It is an object of the present invention to provide a shoe with an inflatable tongue that can be used by the elderly, infirm or overweight.

It is another object of the present invention to provide a shoe with an inflatable bladder which allows the shoe to be placed on the human foot and to properly inflate it and deflate it without the action of human hands.

It is a further object of the present invention to provide a shoe with an inflatable tongue which can provide an attractive appearance like any other shoe.

It is a further object of the present invention to provide a shoe with an inflatable tongue which is adapted for use in association with loafers and/or sandals.

It is still a further object of the present invention to provide a shoe which is easy to use, relatively inexpensive, and easy to manufacture.

These and other objects and advantages of the present invention will become apparent from a reading of the attached specification and appended claims.

BRIEF SUMMARY OF THE INVENTION

The present invention is a shoe comprising a sole, an upper affixed to the sole and extending upwardly therefrom, a tongue fixedly and non-releasably secured to the upper, an air pump affixed to the toe portion, a bladder in valved communication with an exhaust of the air pump, and a deflator interconnected in valved relationship with the bladder. The air pump has an intake and an exhaust. The bladder is in valved communication with the exhaust of the pump. The bladder is affixed to a surface of the tongue. The bladder is inflatable by an action of the air pump. The deflator is connected to the heel portion of the upper.

A tubing has one end connected to an outlet of the bladder and extends along a side of the upper. The tubing extends along the interior surface of the upper and is juxtaposed against a top surface of the sole. The tubing allows air from the bladder to be released by way of the deflator.

The deflator comprises a valve having a pin extending upwardly therefrom. The pin is movable downwardly so as to release air from the bladder through the tubing. An actuator is affixed to the upper in cooperation with the pin. This actuator is a flexible spoon-shaped member affixed to an interior surface of the upper at the heel portion. The spoon-shaped member has a surface overlying a top of the pin.

The bladder has an inverted U-shaped configuration. The bladder has an exterior surface contacting an interior surface of the tongue. The air pump is a bellows-type air pump. In particular, the air pump includes a top panel, a flexible bellows material affixed to the underside of the top panel, and a bottom panel affixed to a bottom of the bellows material. An elastomeric foam section is interposed between the bellows material and the bottom panel. The intake and the exhaust are connected to the flexible bellows material. The top panel is of a material matching the material of the upper at the toe portion.

The shoe is in the nature of a loafer, a sandal or a woman's shoe. The bladder can be inflated by applying a pressure to the top panel of the air pump so as to create a compressive pressure therewith (e.g. by the placement of the heel of the other foot thereon). The human foot can easily slide into the opening in the upper so as to have a top surface of the foot resting against the inner surface of the bladder. Air can be released by simply using the other foot to compress the flexible spoon-shaped flap downwardly onto the pin of the valve such that air is released from the bladder by way of the deflator.

DETAILED DESCRIPTION OF THE PRESENT INVENTION

Figure 1:
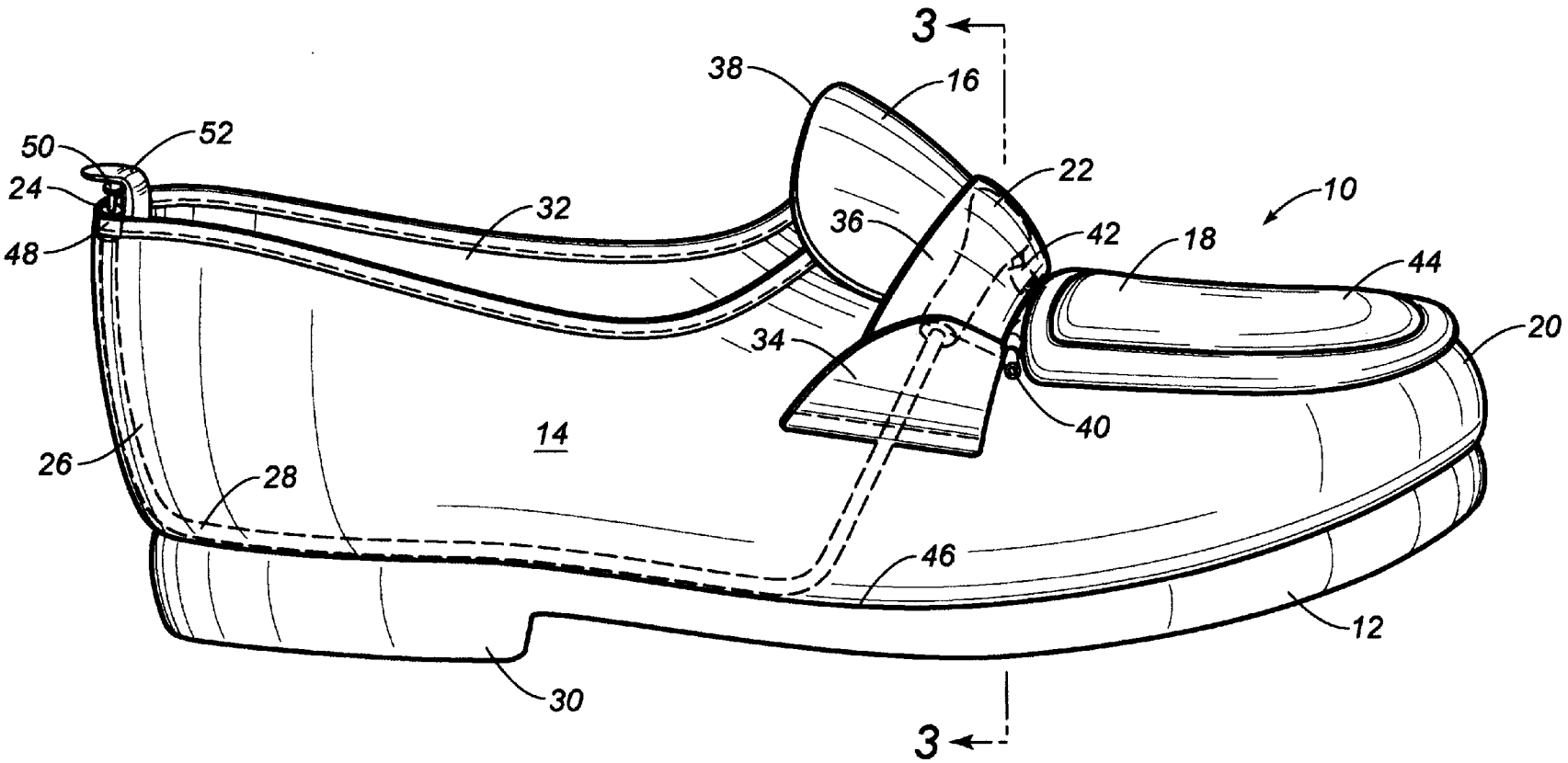
FIG. 1 is a side elevational view showing the preferred embodiment of the present invention.

Referring to FIG. 1, there is shown the shoe 10 in accordance with the preferred embodiment of the present invention. The shoe 10 includes a sole 12, an upper 14 affixed to the sole 12 and extending upwardly therefrom, a tongue 16 fixedly and non-releasably secured to the upper 14, an air pump 18 affixed to the toe portion 20 of the upper 14, a bladder 22 in valved communication with the exhaust of the air pump 18 and affixed to a surface of the tongue 16, and a deflator 24 affixed to the heel portion 26 of the upper 14. The deflator 24 is connected by a tube 28 to the bladder 22.

In FIG. 1, it can be seen that the sole 12 is a conventional sole as used on a shoe. A heel 30 is formed in the sole 12 adjacent to the heel portion 26 of the upper 14.

The upper 14 is formed of a leather or other synthetic material. The upper 14 is configured in the style of a loafer in FIG. 1. The upper 14 includes toe portion 20 located at a forward end thereof and heel portion 26 located at a rear end thereof. An opening 32 is formed in the top surface of the upper 14 so as to allow a human foot to be inserted into the interior of the shoe 10. The upper 14 is affixed to the sole 12 by sewing or by adhesives. The upper 14 extends upwardly from the sole 12.

The tongue 16 is in the nature of a tongue as used with conventional loafers. In other words, the tongue 16 is fixedly and non-releasably secured to the upper. As used herein, the term "fixedly and non-releasably" means that the tongue 16 is not laced into its proper position. In each of the embodiments of the shoe 10 of the present invention, no laces are required for the proper attachment of the shoe 10 to a human foot. Typically, the tongue 16 is held in position by side flaps 34 and a belt-type strap 36 extending over the top surface of the tongue 16. Various other configurations of tongue 16 can be made within the scope of the present invention. FIG. 1 simply shows one manner in which the tongue 16 is fixedly and non-releasably affixed to the upper 14. The tongue 16 will have an end 38 which extends over the opening 32 of the upper 14. The tongue 16 is located between the air pump 18 and the deflator 24.

The air pump 18 has a particular configuration in the present invention (as will be described hereinafter in association with FIG. 4). The air pump 18 is affixed to the toe portion 20 of the upper 14. The air pump 18 will have an intake 40 and an outlet 42 (shown in broken lines). The air pump 18 has a top panel 44 which is of a similar material as the material used for the toe portion 20 of the upper 14. The intake 40 is an opening which allows air to be passed into the interior of the air pump 18 and then passed through the exhaust 42 into the bladder 22. The air pump 18 is a bellows-type air pump. Actuation of the air pump 18 can simply be carried out by placing the other foot on the top panel 44 and applying a compressive pressure onto the interior of the air pump 18. This will cause air to be drawn through the intake 40, into the interior of the air pump 18 and outwardly of the exhaust 42. The intake 40 and the exhaust 42 are each one way valves which will allow a unidirectional transfer of air into the pump 18 and outwardly therefrom.

The bladder 22 is illustrated in broken line fashion as located within the interior surface of the tongue 16. As such, the bladder 22 will be interposed between the top of the foot and the inner surface of the tongue 16. The inflation of the bladder 22 will cause a tighter fit between the foot and the interior of the shoe 10. The bladder 22 can be formed from a synthetic or natural rubber material which will allow the bladder to be inflated or deflated repeatedly. The material used for the bladder 22 can be also any other material which is wear resistant. Various overlays can be also placed over the surface of the bladder 22 so as to prevent early deterioration of the bladder 22 from repeated use.

Tubing 28 is connected to an outlet of the bladder 22 and extends along a side of the upper 14 toward the deflator 24. In particular, the tubing 28 will extend downwardly from the bladder 22 and extend along the top edge 46 of the sole 12. This will provide structural support to the tubing 28 and prevent early damage to the tubing 28. The positioning of the tubing 28 in the corner of the interior of the shoe will keep the tubing 28 in a protected position and will not interfere with the comfort of the shoe 10. The tubing 28 should be formed of a suitable material that can bend sharply without collapsing. The tubing 28 has an end connected to the deflator 24. As can be seen, the tubing 28 will extend upwardly along the interior of the heel portion 26 of the upper 14.

The deflator 24 includes a valve 48 having a pin 50 extending upwardly therefrom. The valve 48 is positioned at the top of the opening 32 of the upper 14 at the heel portion 26. The pin 50 of the valve 48 is movable downwardly so as to release air from the bladder 22 through the tubing 28. An actuator 52 is affixed to the upper 14 at the opening 32 and is cooperative with the pin 50. In particular, the actuator 52 is a flexible spoon-shaped flap which is affixed to the interior surface of the upper 14 at the opening 32 adjacent to the heel portion 26. The flap 52 has a surface which overlies the top of the pin 50. As a result of this configuration, the user can simply take his or her other foot and apply a pressure to the flap 52 so as to press the pin 50 downwardly into the valve 48 and, thereby, release pressure from the bladder 22. After air is released from the bladder 22, the shoe 10 can easily be removed by simply applying a pressure by the other foot onto the heel 30 of the sole 12 or to the surface of the upper 14 whereby the shoe 10 easily slides off the foot.

Figure 2:
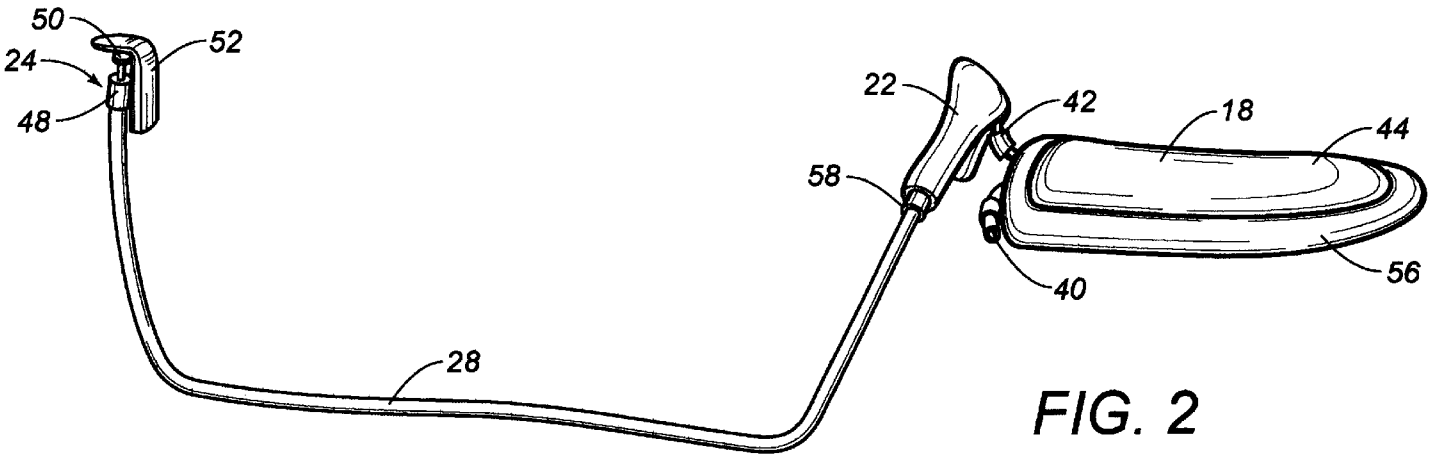
FIG. 2 is an interior view showing the structure of the inflation and deflation device of the present invention.

FIG. 2 shows a detailed view of the interior construction of the inflation mechanism associated with the present invention. In particular, it can be seen that the pump 18 has top panel 40 overlying the flexible bellows material 56. The air pump 18 has an intake 40 and an exhaust 42. Each of the intake 40 and the exhaust 42 has one way valves associated therewith. As a result, when pressure is applied to the top panel 44 of the bellows-type air pump 18, air can only be drawn through the intake 40 and not released therethrough. Similarly, air on the interior of the air pump 18 can only be released by passing through the exhaust 42. Exhaust 42 is in valved communication with the bladder 22. Bladder 22 has an outlet 58 connected to one end of the tubing 28. Tubing 28 extends so as to have an opposite end connected to the valve 48 associated with the deflator 24. It can be seen that the pin 50 extends upwardly from the valve 40. The flap 52 is positioned so as to overlie the top of the pin 50.

Figure 3:
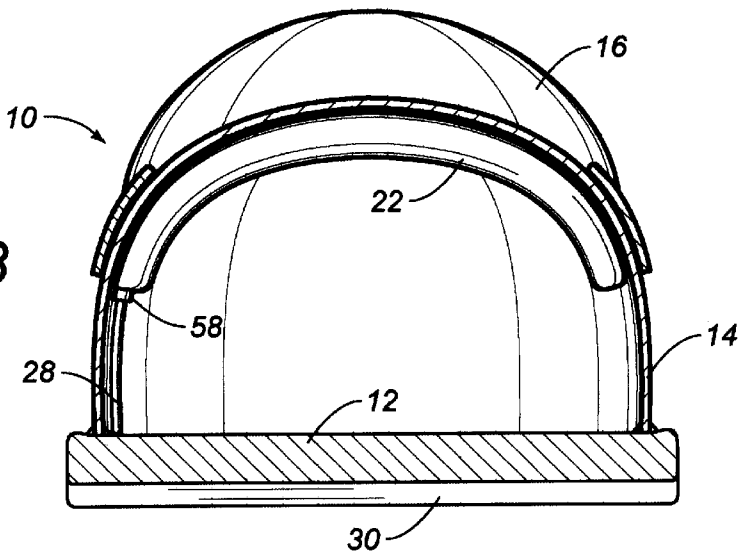
FIG. 3 is a cross-sectional view taken across lines 3—3 of FIG. 1.

FIG. 3 shows the interior of the shoe 10. In particular, it can be seen in FIG. 3 that the sole 12 has a heel portion 30 extending downwardly therefrom. The upper 14 extends upwardly from the sole 12. The tongue 16 will extend upwardly from the upper 14. The bladder 22 is illustrated as positioned on the interior surface of the tongue 16. Bladder 22 has an inverted U-shaped construction. Tubing 28 is connected to the outlet 58 of the bladder 22. When the bladder 22 is suitably inflated, it will take up any space between the top of the foot and the inner surface of the tongue 16. When the bladder 22 is deflated, space will exist between the tongue 16 and the top of the foot. As a result, the foot can be easily removed from the shoe 10.

Figure 4:
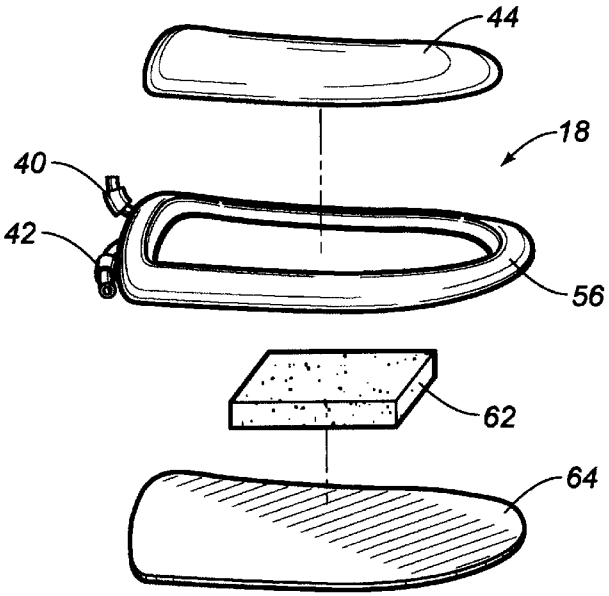
FIG. 4 is an exploded view of the air pump of the present invention.

FIG. 4 shows an exploded view of the air pump 18. Air pump 18 includes a top panel 44 positioned on a flexible bellows material 56. A foam elastomer section 62 is affixed to a bottom surface of the bellows material 56. Finally, a bottom panel 64 is affixed to a bottom of the bellows-material 56 so that the elastomeric foam section 62 is interposed between the bottom panel 64 and the bellows-type material 56. Intake 40 and exhaust 42 are connected to the bellows material 56. The foam elastomer 62 can be sponge rubber. The top 44 can be made from any suitable material or may be covered by any material which matches the material used for the toe portion 20 of the upper 14. These materials can include thick leather, fiberglass, plastic or metal. The flexible bellows material 56 can be made from materials that can be flexed repeatedly without wearing. The foam elastomer 62 should provide a spring action after compression so that the bellows 56 will be raised open. The bellows 56 should be impervious to water. The bottom panel 64 can be made from the same material as that of the top panel 44.

Figure 5:
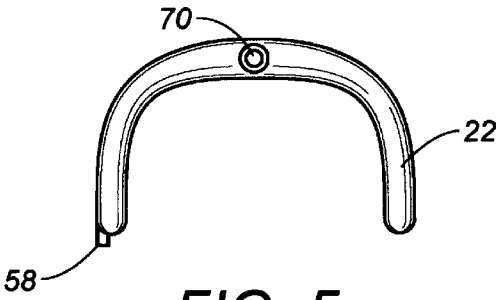
FIG. 5 is a detailed isolated side view of the bladder of the present invention.

FIG. 5 illustrates the configuration of the bladder 22. Bladder 22 has an inlet 70 which is connected to the exhaust 42 associated with the air pump 18. The inlet 70 is located centrally of the inverted U-shaped body of the bladder 22. This will allow air to distribute rather evenly throughout the interior of the bladder 22. The outlet 58 of the bladder 22 is located at the bottom of the bladder 22 in a proper position for connection to the tubing 28.

Figure 6:
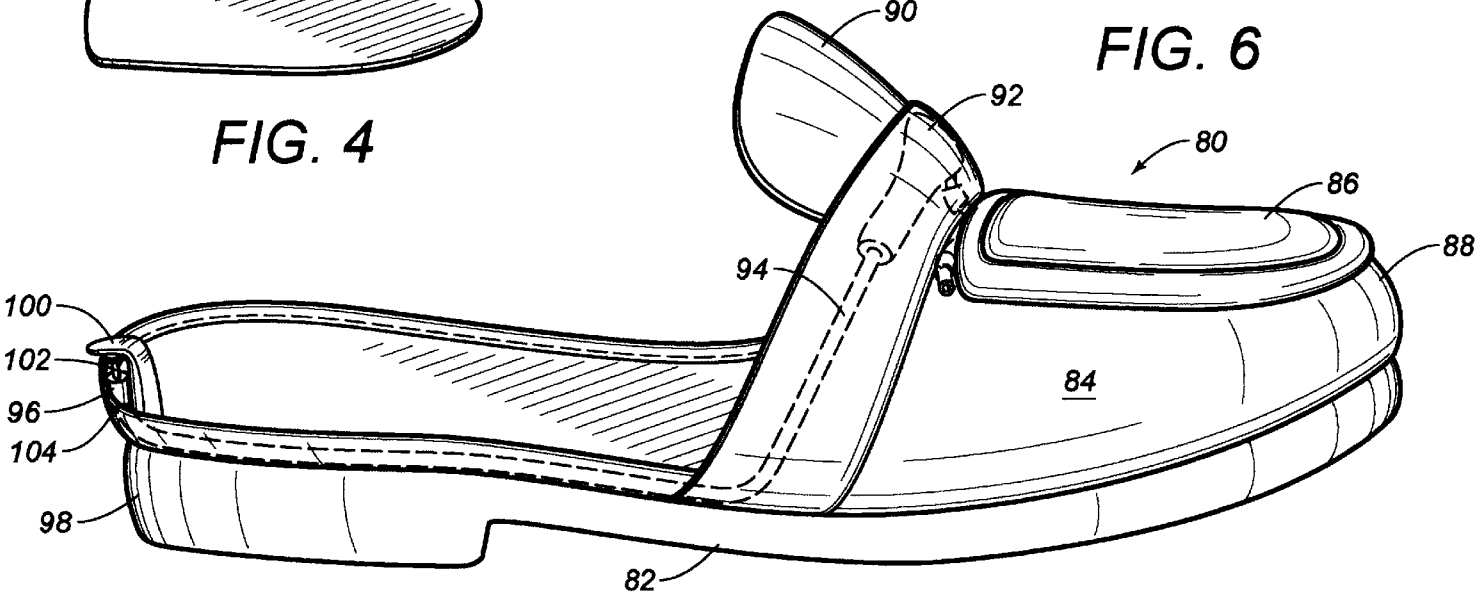
FIG. 6 is a perspective view showing the present invention as applied to a sandal.

FIG. 6 shows the configuration of the present invention as used with a sandal 80. It can be seen that the sandal 80 has a sole 82, with an upper 84 extending therefrom. The air pump 86 is located on the toe portion 88 of the upper 84. Tongue 90 extends rearwardly from the toe portion 88 of the upper 84. It can be seen that the bladder 92 is located on the inner surface of the tongue 90. Tubing 94 is connected to the bladder 92 and extends downwardly therefrom along the inner surface of the upper 84. Tubing 94 will extend along the top of the sole 82 of the shoe 80. A deflator 96 having a similar configuration to that of the preferred embodiment of the present invention is located at the heel portion 98 of the shoe 80. Flap 100 overlies pin 102 associated with the valve 104 of the deflator 96. As can be seen, a tight fit between the foot and the interior of the sandal 80 is achieved by applying pressure to the air pump 86 so that the bladder 92 inflates. When it is desired to remove the sandal 80, a pressure can be applied to the top surface of the flap 100 so as to compress the pin 102 within the valve 104 thereby releasing pressure from the interior of the bladder 92.

Figure 7:
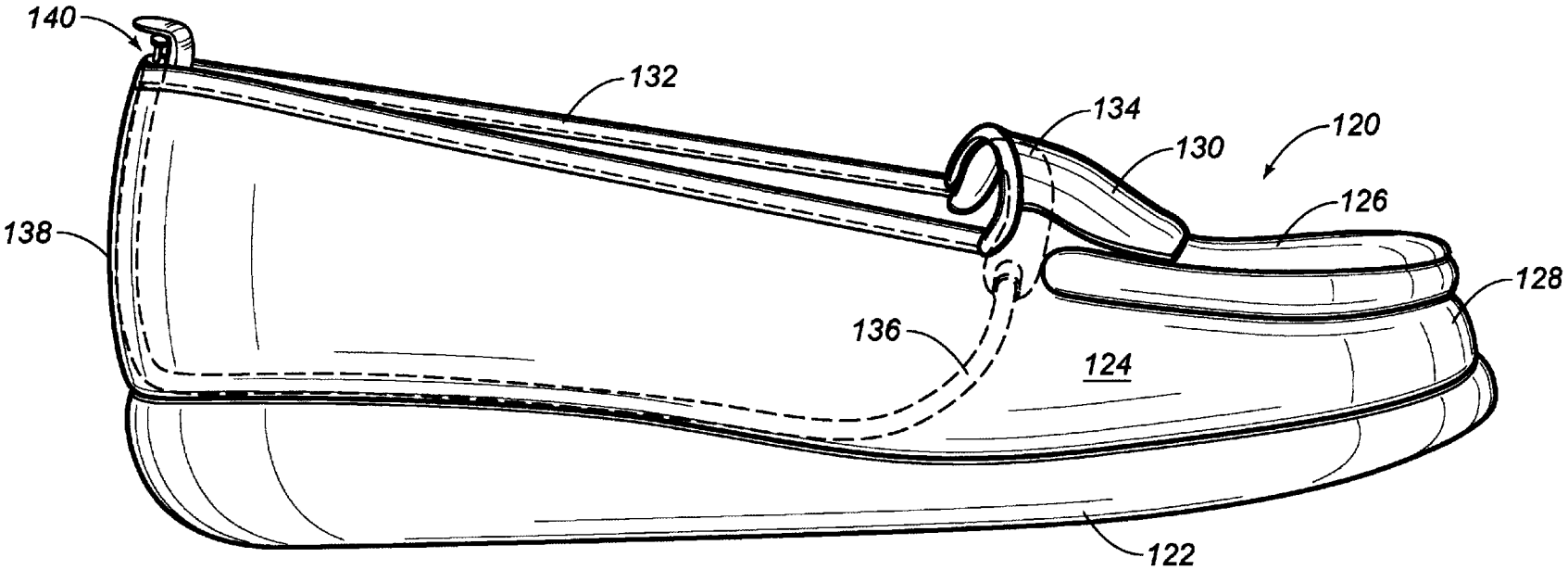
FIG. 7 is a side elevational view showing the present invention as applied to a woman's shoe.

FIG. 7 shows the present invention as applied to a woman's shoe 120. Once again, the woman's shoe 120 has a sole 122 and an upper 124 extending upwardly therefrom. Air pump 126 is affixed to the top surface of the toe portion 128 of the upper 124. Tongue 130 is fixedly and non-releasably secured to the upper 124. An opening 132 is provided so as to allow the human foot to enter the interior of the shoe 120. Bladder 134 is affixed within the tongue 130 generally adjacent to the opening 132. Tubing 136 is connected to the bladder 134 and will extend toward the heel portion 138 of the upper 124. Deflator 140 is positioned at the top of the heel portion 138 adjacent to the opening 132. The woman's shoe 120 can be inflated or deflated in the manner described hereinbefore.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A shoe comprising:

a sole;

an upper affixed to said sole and extending upwardly therefrom, said upper having a toe portion and a heel portion;

a tongue fixedly and non-releasably secured to said upper;

an air pump affixed to said toe portion, said air pump having an intake and an exhaust;

a bladder in valved communication with said exhaust of said air pump, said bladder affixed to a surface of said tongue, said bladder being inflatable by an action of said air pump;

a deflator affixed to said heel portion of said upper, said deflator being connected in valved relationship to said bladder; and a tube having one end connected to an outlet of said bladder and extending along a side of said upper, said tubing connected to said deflator, said tubing extending along an interior surface of said upper, said tubing being juxtaposed against a top surface of said sole.

2. A shoe comprising:

a sole;

an upper affixed to said sole and extending upwardly therefrom, said upper having a toe portion and a heel portion;

a tongue fixedly and non-releasably secured to said upper;

an air pump affixed to said toe portion, said air pump having an intake and an exhaust;

a bladder in valved communication with said exhaust of said air pump, said bladder affixed to a surface of said tongue, said bladder being inflatable by an action of said air pump; and a deflator affixed to said heel portion of said upper, said deflator being connected in valved relationship to said bladder, said deflator comprising:

a valve having a pin extending upwardly therefrom, said pin being movable downwardly so as to release air from said bladder; and an actuator affixed to said upper and cooperative with said pin, said actuator comprising a flexible concave member affixed to an interior surface of said upper at said heel portion, said concave member having a concave surface overlying a top of said pin.

3. The shoe of claim 2, said bladder having an inverted U-shaped configuration, said bladder having an exterior surface contacting an interior surface of said tongue.

4. The shoe of claim 1, aid air pump comprising:

a top panel;

a flexible bellows material affixed to an underside of said top panel; and a bottom panel affixed to a bottom of said bellows material.

5. The shoe of claim 4, said air pump further comprising:

an elastomeric section interposed between said bellows material and said bottom panel.

6. The shoe of claim 4, said intake and said exhaust being connected to said flexible bellows material.

7. The shoe of claim 4, said upper being formed of a material, said top panel being of a material identical to said material of said upper.

8. A shoe comprising:

a sole;

an upper affixed to said sole and extending upwardly therefrom, said upper having a toe portion and a heel portion, said upper being formed of a material;

a tongue fixedly and non-releasably secured to said upper rearwardly of said toe portion;

an air pump means affixed to said toe portion, said air pump means comprising:

a top panel;

a flexible bellows material affixed to an underside of said top panel; and a bottom panel affixed to a bottom of said bellows material, said air pump means being affixed to an opposite end of said upper from said deflator means, said top panel being of a material identical to said material of said upper;

a bladder being in valved communication with said air pump means, said bladder affixed to a surface of said tongue, said air pump means for inflating said bladder by a compressive force applied to said air pump means, said bladder having a generally inverted U-shaped configuration and affixed to an interior surface of said tongue; and a deflator means affixed to said upper at a different location than said air pump means, said deflator means for selectively releasing air from said bladder.

9. The shoe of claim 8, further comprising:

a tubing having one end connected to an outlet of said bladder and having another end connected to said deflator means.

10. The shoe of claim 1, said deflator means comprising:

a valve having a pin extending upwardly therefrom, said pin being movable downwardly so as to release air from said bladder by way of a tube extending from said bladder to said deflator means; and an actuator affixed to said upper and cooperative with said pin, said valve and said pin being positioned at said heel portion of said upper.

11. The shoe of claim 10, said actuator comprising:

a flexible flap affixed to an interior surface of said upper at said heel portion, said flexible flap extending outwardly and rearwardly from said upper so as to overly a top of said pin.

* * * * *